US009624455B2

(12) United States Patent
Labarre et al.

(10) Patent No.: US 9,624,455 B2
(45) Date of Patent: Apr. 18, 2017

(54) DETERGENT COMPOSITION WITH ANTI-SPOTTING AND/OR ANTI-FILMING EFFECTS

(75) Inventors: Dominique Labarre, Neuilly (FR); Marie-Pierre Labeau, Burlington, NJ (US); Florence Lambert, Paris (FR); Céline Orizet, Bourg-la-Reine (FR); Gilda Lizarraga, Chesterfield, NJ (US); Véronique Geoffroy, Saint-Leu-la-Foret (FR)

(73) Assignee: Rhodia Operations, Aubervilliers (FR)

( * ) Notice: Subject to any disclaimer, the term of this patent is extended or adjusted under 35 U.S.C. 154(b) by 0 days.

(21) Appl. No.: 13/823,448

(22) PCT Filed: Sep. 30, 2011

(86) PCT No.: PCT/EP2011/067075

§ 371 (c)(1),
(2), (4) Date: Jul. 29, 2013

(87) PCT Pub. No.: WO2012/042001

PCT Pub. Date: Apr. 5, 2012

(65) Prior Publication Data

US 2013/0310298 A1 Nov. 21, 2013

Related U.S. Application Data

(60) Provisional application No. 61/344,772, filed on Oct. 1, 2010.

(51) Int. Cl.

| | |
|---|---|
| ***B08B 3/04*** | (2006.01) |
| ***C11D 1/62*** | (2006.01) |
| ***C11D 3/22*** | (2006.01) |
| ***C11D 3/00*** | (2006.01) |
| ***C11D 11/00*** | (2006.01) |

(52) U.S. Cl.

CPC ..... *C11D 3/0036* (2013.01); *C11D 3/227* (2013.01); *C11D 11/0023* (2013.01)

(58) Field of Classification Search

CPC .... B08B 3/04; C11D 1/62; C11D 3/22; C11D 3/222; C11D 3/227

USPC ..... 510/221, 224, 237, 470, 473, 499, 504; 134/25.2, 25.3, 39, 42

See application file for complete search history.

(56) References Cited

U.S. PATENT DOCUMENTS

| | | | | |
|---|---|---|---|---|
| 3,589,578 | A | 6/1971 | Kamphausen | |
| 4,031,307 | A | 6/1977 | DeMartino et al. | |
| 4,101,456 | A * | 7/1978 | Renaud et al. | 510/429 |
| 5,489,674 | A | 2/1996 | Yeh | |
| 5,536,825 | A | 7/1996 | Yeh et al. | |
| 5,756,720 | A | 5/1998 | Chowdhary | |
| 5,952,278 | A | 9/1999 | Mao | |
| 6,239,091 | B1 | 5/2001 | Tartakovsky et al. | |
| 6,239,578 | B1 | 5/2001 | Schnell et al. | |
| 6,833,347 | B1 | 12/2004 | Wang et al. | |
| 7,067,499 | B2 | 6/2006 | Erazo-Majewicz et al. | |
| 8,343,286 | B2 | 1/2013 | Neplenbroek et al. | |
| 2003/0044479 | A1 | 3/2003 | Wielinga et al. | |
| 2003/0211952 | A1* | 11/2003 | Erazo-Majewicz et al. | 510/119 |
| 2005/0227902 | A1* | 10/2005 | Erazo-Majewicz et al. | 510/470 |
| 2007/0078071 | A1* | 4/2007 | Lee | A61K 8/11 510/130 |
| 2009/0101168 | A1* | 4/2009 | Swidler | 134/6 |
| 2010/0154831 | A1 | 6/2010 | Neplenbroek et al. | |
| 2011/0232691 | A1* | 9/2011 | Neplenbroek | C11D 3/227 134/25.2 |

FOREIGN PATENT DOCUMENTS

| | | |
|---|---|---|
| EP | 2 395 072 | 12/2011 |
| JP | 2007 169473 | 7/2007 |
| JP | 2011 080053 | 4/2011 |

OTHER PUBLICATIONS

International Search Report for PCT/EP2011/067075 dated Feb. 6, 2012.

Database WPI Week 200760, Thomson Scientific, London, GB; AN 2007-630556, XP002667580, & JP 2007 169473 A (Kao Corp) (Jul. 5, 2007) abstract.

Database WPI, Week 201130, Thomson Scientific, London, GB; AN 2011-E14402, XP002667581, & JP 2011 080053 A (Lion Corp) (Apr. 21, 2011) abstract.

Solarek, D.B., "Cationic Starches", 1986, Modified Starches: Properties and Uses, Chapter 8, CRC Press, Inc., pp. 113-129; 19 pgs.

Carr, M.E., "Preparation of Cationic Starch Containing Quaternary Ammonium Substituents by Reactive Twin-Screw Extrusion Processing", 1994, Journal of Applied Polymer Science, vol. 54, pp. 1855-1861; 7 pgs.

Hellwig, G., et al—"Production of Cationic Starch Ethers Using an Improved Dry Process", 1992, Starch/Starke, vol. 44, No. 2, pp. 69-74; 6 pgs.

Grano, H., et al—"Preparation of starch betainate: a novel cationic starch derivative", 2000, Carbohydrate Polymers, vol. 41, Elsevier, pp. 277-283; 7 pgs.

* cited by examiner

*Primary Examiner* — Brian P Mruk

(57) ABSTRACT

The present invention relates to an Automatic Dishwashing (ADW) detergent composition comprising at least one cationic polysaccharide of molecular weight of less than 1,000,000 g/mol. The invention also relates to a method for eliminating, limiting or preventing the spotting and/or filming phenomena during the washing comprising the use of a detergent composition according to claim 1.

14 Claims, No Drawings

DETERGENT COMPOSITION WITH ANTI-SPOTTING AND/OR ANTI-FILMING EFFECTS

This application is a 371 application of International Application No. PCT/EP2011/067075, filed Sep. 30, 2011, which claims the benefit of U.S. Provisional Application Ser. No. 61/344,372, filed Oct. 1, 2010.

The present invention concerns new detergent formulations, especially for Automatic Dishwashing (ADW), comprising cationic polysaccharide which reduces or eliminates the formation of spots and films.

One of the major problems of the dish washing by ADW is the formation of spots and film, especially on the glassware. The spots correspond to water traces left after the water evaporation, the phenomenon is known under the term of spotting. The film corresponds to a uniform deposition all over the glassware surface, especially the film may result from the formation of a mineral precipitate, the phenomenon is known under the term of filming. Moreover, carbonate and phosphate salts that are conventionally used in detergent contribute to the formation of films on glassware. One solution implemented to limit spotting and/or filming was to use surfactant. However, those kinds of compounds are not environmental friendly.

It is known from U.S. Pat. No. 6,239,091 a detergent or rinse aid composition comprising water soluble cationic or amphoteric polymer which provides superior glassware appearance as evidenced by reduced spotting and filming. The inventors underline that a particularly useful class of cationic polymers in this invention are copolymers of diallyldimethylammonium salt and hydroxyethylcellulose designated as polyquaternium 4 with molecular weights greater than 1,000,000 g/mol.

It is also known from WO2008/147940 a detergent composition comprising polysaccharide, especially cationic modified guar gums (e.g. Jaguar C17) of molecular weight greater than 1,000,000 g/mol.

The objective of the invention is to provide ADW detergent composition which limits even more eliminates the filming and spotting phenomena.

One objective of the present invention is to replace part of the surfactant currently used in detergent compositions while keeping the anti-filming and/or anti-spotting effect and/or to improve the anti-filming and/or anti-spotting effect of the known detergent compositions. Another objective of the present invention is to replace all the surfactant currently used in detergent compositions while keeping the anti-filming and/or anti-spotting effect and/or to improve the anti-filming and/or anti-spotting effect of the known detergent compositions.

The present invention relates to a detergent composition, especially to an ADW detergent composition, especially to a domestic ADW composition, comprising at least one cationic polysaccharide of average molecular weight of less than 1,000,000 g/mol.

As used herein, the "average molecular weight" of the cationic polysaccharide means the weight average molecular mass of said cationic polysaccharide.

The average molecular weight of the cationic polysaccharide may be measured by SEC-MALS (Size Exclusion Chromatography with detection by Multi-Angle Light-Scattering detection). A value of 0.140 for dn/dc is used for the molecular weight measurements. A Wyatt MALS detector is calibrated using a 22.5 KDa polyethylene glycol standard. All calculations of the molecular weight distributions are performed using Wyatt's ASTRA software. The samples are prepared as 0.05% solutions in the mobile phase (100 mM $Na_2NO_3$, 200 ppm $NaN_3$, 20 ppm pDADMAC) and filtered through 0.45 μm PVDF filters before analysis. The average molecular weights are expressed by weight.

The inventors have found that replacing all or part of surfactant currently used on ADW detergent composition with cationic polysaccharide of average molecular weight less than 1,000,000 g/mol or adding such polysaccharide in ADW detergent composition enables elimination, prevention and limitation of the spotting and/or filming phenomena.

Typically, the cationicity of the non-cellulosic polysaccharide derivative can be expressed in terms of degree of substitution.

The cationic degree of substitution may be determined before or after an acidic methanol extraction. The acidic methanol extraction may be considered as a washing step, allowing the removal of the other quaternary ammonium compounds present at the end of the reaction, being it residual cationizing reagent or by-products of unreacted cationizing agent.

In general, the cationic degree of substitution after acidic methanol extraction $(DS_{cat})_{extraction}$ is lower than the cationic degree of substitution before said extraction $(DS_{cat})$.

In the present invention, the cationic degree of substitution determined after the acidic methanol extraction $(DS_{cat})_{extraction}$ is more precise.

As used herein, the $(DS_{cat})$ or $(DS_{cationic})$ relates to the cationic degree of substitution measured before the acidic methanol extraction.

As used herein, the $(DS_{cat})_{extraction}$ or $(DS_{cat})_{extc}$ relates to the cationic degree of substitution measured after the acidic methanol extraction.

As used herein, the expression "cationic degree of substitution" $(DS_{cat})$ or $(DS_{cat})_{extraction}$ means the average number of moles of cationic groups per mole of sugar unit. The $(DS_{cat})$ or $(DS_{cat})_{extraction}$ may be measured by means of $^1$H-NMR (solvent: $D_2O$).

Once the 1H NMR spectrum is obtained, the integration of the multiplet of peaks corresponding to the anomeric proton on all guar units, usually between 3.2-4.3 ppm, is normalized to unity. The peak of interest, the one corresponding to the methyl protons of the quaternary ammonium group on guar units, is centered around 1.8 ppm. This peak is integrated for 9 protons given that there are 3 methyl groups on the ammonium function. Therefore the calculation of the $(DS_{cationic})$ for the case of the cationizing agent 2,3-epoxypropyltrimethylammonium chloride is as follows:

$$DS = \frac{\text{INTEGRAL_N}\ (Me)3}{\text{INTEGRAL_anomeric_proton}} \Big/ 9$$

The measurement of the degree of cationic substitution was made before $(DS_{cationic})$ and after a cleaning protocole $(DS_{cat})_{extraction}$. The true value of degree of cationic substitution is thus considered to be that measured after removal of cationic impurities. Indeed, the presence of the residuals/by-products of the cationic reagent is evidenced by the smaller peaks at lower field than the peak of interest centered around 1.8 ppm and in fact leads to an increase of the apparent value of $(DS_{cationic})$.

According to the present invention, a process of extraction of the cationic polysaccharide may be carried out in acidified methanol (50:1, $MeOH/HCl_{concentrated\ 37\%}$, v/v) for removing all of cationic reagent impurities. Thus, the cationic polysaccharide is added to an acidified methanol mixture in a concentration equivalent to approximately 1%, under stirring. This dispersion is then brought to reflux temperatures and held at temperature for 45 minutes. At the end of this process of extraction, the solvent is decanted and the process is repeated twice more with fresh acidified solvent. After the last extraction the resulting cationic polysaccharide is filtered and washed with pure methanol. The so purified cationic polysaccharide derivative is then dried and ground before NMR analysis.

In one embodiment the degree of cationic substitution after extraction $(DS_{cat})_{extraction}$ is comprised between 0.01 and 0.4, preferably between 0.03 and 0.3, for example between 0.05 and 0.25. The degree of cationic substitution expresses the average number of moles of cationic group per mole of sugar unit.

According to the present invention the term "between x and y" should be understood as including the values x and y. In the present invention, the expression "between x and y" also means "from x to y".

Preferably the cationic polysaccharide does not result from the polymerisation of a cationic monomer on the polysaccharide backbone, not from the grafting of preformed cationic polymers onto the polysaccharide backbone.

According to the invention zwitterionic groups are not comprised in the meaning of cationic group.

As used herein, the term "cationic groups" refers to positively charged groups and to partially charged groups.

As used herein, the expression "partially charged groups" designates groups which may become positively charged depending of the pH of the formulation. Such groups may also be named "potentially cationic groups".

As used herein, the term "cationic" means at least partially cationic. Thus, the terms "cationizing agents", "cationic groups" and "cationic moieties" include ammoniums (which have a positive charge) but also primary, secondary and tertiary amines and their precursors (which can lead to positively charged compounds).

According to the invention, the polysaccharide is derivatized or modified by a cationizing agent so as to contain a cationic group. The resulting compound is the cationic polysaccharide.

Cationizing agents of the present invention are defined as compounds which, by reaction with the polysaccharide can lead to a polysaccharide derivative comprising at least one cationic group according to the invention. Cationizing agents of the present invention are defined as compounds which contain at least one cationic moiety. Cationizing agents comprise agents which can lead to cationic modified polysaccharide.

A group of suitable cationizing agents typically contain a reactive functional group, such as an epoxy group, a halide group, an ester group, an anhydride group or an ethylenically unsaturated group, and at least one cationic moiety or a precursor of such cationic moiety.

The cationic polysaccharide used in the present invention can be chosen in the group consisting of the polymers with polysaccharide backbone comprising cationic group, such as those described in U.S. Pat. No. 3,589,578 or U.S. Pat. No. 4,031,307.

In one embodiment the cationic polysaccharide is chosen among cationic cellulose or cationic cellulose derivatives (such as cationic cellulose ethers and cationic cellulose esters), cationic guar or cationic guar derivatives (such as cationic guar ethers and cationic guar esters), cationic starch or cationic starch derivatives (such as cationic starch ethers and esters), alone or in mixture. Preferably the cationic polysaccharide is cationic guar.

The polysaccharides are chemically modified to introduce lateral groups on the polysaccharide backbone, generally the groups are linked via ether bonds where the oxygen atom corresponds to the hydroxyl groups of the polysaccharide backbones which have reacted to create the bond.

The cationic group of the cationic polysaccharide can be chosen in the group consisting of quaternary ammonium groups, typically carrying three radicals which identical or different and chosen in the group consisting of hydrogen, an alkyl radical comprising from 1 to 22 carbon atoms, preferably from 1 to 6 carbon atoms, advantageously from 1 to 3 carbon atoms, or an aryl; those three radicals are preferably alkyl radicals which are identical or different. Typically, the quaternary ammonium groups are chosen in the group consisting of trialkylammonium, such as trimethylammonium, triethylammonium, tributylammonium; aryldialkylammonium, especially benzyldimethylammonium and/or ammonium radicals in which the nitrogen atom is a member of a cyclic structure, such as pyridinium and imidazoline radicals. The counter ion of the quaternary ammonium group is generally an halogen, especially chloride, bromide or iodide.

As example of reactive agent which enables to introduce such cationic group on the polysaccharide backbone, we may mention:

- cationic epoxides, e.g. 2,3-epoxypropyltrimethylammonium chloride, 2,3-epoxypropyltrimethylammonium bromide or 2,3-epoxypropyltrimethylammonium iodide; and their non-cationic precursors;
- halogens carrying cationic functions, such as 3-halogeno-2-hydroxypropyl trimethylammonium chloride, for example e.g. 3-chloro-2-hydroxypropyl trimethylammonium chloride, 3-chloro-2-hydroxypropyl-lauryldimethylammonium chloride, 3-chloro-2-hydroxypropyl-stearyldimethylammonium chloride; and their non-cationic precursors;
- unsaturated ethylenically monomers carrying cationic functions, e.g methacrylamidopropyl trimethylammonium; trimethylammoniumpropyl methacrylamide methylsulfate salt, diallyl dimethyl ammonium chloride, vinyl benzyl trimethylammonium chloride, precursor of cationic monomers such as N-vinyl formamide, N-vinylacetamide (whose units can be hydrolyzed after polymerization or grafted onto vinyl amine units), and their non-cationic precursors;

The reactive agent could also be non cationic precursors of the reactive mentioned above, e.g. the cationic guar can be obtained by grafting with chloroalkyl dialkylamine (e.g. diethylaminoethylchloride, dimethylaminopropylmethacrylamide . . . ) followed by a step of quaternarization, such step is known from the person skilled in the art and can be, for example, carried out with dimethylsulfate, diethylsulfate and methyl chloride.

As example of cationic cellulose, mention may be made to cationic cellulose chosen in the group consisting of cationic cellulose derivative from cellulose ether of poly (oxyethanediyl-1,2)hydroxyl-2 chloride of trimethylammonium-3-propyl or polyquaternium 10 (PQ10).

The cellulose can be in particular cellulose ether as described in U.S. Pat. No. 6,833,347.

As example of cationic guars, mention may be made to cationic guar obtained according to derivatization techniques such as those described in U.S. Pat. No. 5,756,720; EP0,686,643, EP1501873 and US2003/0044479.

Mentioned may be especially made to guar designed, under the INCI terminology, under the name of guar hydroxypropyltrimonium chloride As example of cationic starch mentioned may be made to cationic starches prepared according to methods such as those described in "Cationic starches", by D. B. Solarek, Modified starches: properties and uses, 1986; Carr, M. E. "Preparation of cationic starch containing quaternary ammonium substituents by reactive twin-screw extrusion processing", Journal of Applied Polymer Science, 54: 1855-1861 (1994); Hellwig, G., Bischoff, D. and Rubo, A. "Production of Cationic Starch Ethers Using an Improved Dry Process", Starch—Stärke, 44: 69-74 (1992); H. Grano, "Preparation of starch betainate: a novel cationic starch derivative", Carbohydrate Polymers, 41, 277-283 (2000).

As suitable polysaccharide according to the invention, mention may be made to commercial product such as Polycare® 400 (polyquaternium-10) sell by Rhodia et Ucare® JR-400 (polyquaternium-10) sell by Dow-Amerchol.

Advantageously, the average molecular weight of the cationic polysaccharide is comprised between 50,000 and 800,000 g/mol, preferably between 100,000 and 700,000 g/mol, for example between 200,000 and 600,000 g/mol.

This average molecular weight is determined as mentioned above.

Advantageously, the composition of the invention enables a reduction of the spots and/or films after the washing, especially washing in ADW. Advantageously, the composition of the invention also improves the brightness of the dishes. The composition according to the invention further has a water anti-redeposition effect on the dishes.

Preferably, the dishes concerned are plastic, preferably acrylic, styrene, polypropylene, polyethylene, acrylic blends (SAN, NAS), polycarbonate, melamine, or glass dishes.

In one embodiment, the composition comprises from about 0.1 to 10% by weight of cationic polysaccharide in respect to the total weight of the composition, preferably from about 0.2 to 5%, more preferably from about 0.5 to 3%, for example 1%.

In addition to the ingredients described herein above, the detergent compositions may comprise conventional ingredients, preferably selected from alkalinity sources, builders (i.e. detergency builders including the class of chelating agents/sequestering agents), bleaching systems, anti-scalants, corrosion inhibitors, surfactants, antifoams and/or enzymes. The pH of the detergent composition typically is in the alkaline region, preferably >9, more preferably >10.

Suitable caustic agents include alkali metal hydroxides, e.g. sodium or potassium hydroxides, and alkali metal silicates, e.g. sodium metasilicate. Especially effective is sodium silicate having a mole ratio of $SiO_2Na_2O$ of from about 1.0 to about 3.3, preferably from about 1.8 to about 2.2, normally referred to as sodium disilicate.

Builder Materials

Suitable builder materials (phosphates and non-phosphate builder materials) are well known in the art.

The builder material usable herein can be any one or mixtures of the various known phosphate and non-phosphate builder materials. Examples of suitable non-phosphate builder materials are the alkali metal citrates, carbonates and bicarbonates; and the salts of nitrilotriacetic acid (NTA); methylgiycine diacetic acid (MGDA); glutaric di acetic acid (GLDA), polycarboxylates such as polymaleates, polyacetates, polyhydroxyacrylates, polyacrylate/polymaleate and polyacrylate/polymethacrylate copolymers, as well as zeolites; layered silicas and mixtures thereof.

Examples of phosphate builders are NTA, EDTA, MGDA, GLDA, citrates, carbonates, bicarbonates, polyacrylate/polymaleate, maleic an hydride/(meth) acrylic acid copolymers, e.g. Sokalan CP5 available from BASF, STTP (sodiumtripolyphosphate), preferred phosphate builder is STTP.

The weight ratio of those builders regarding the total weight of the composition is the typical weight ratio in the ADW composition application, e.g. it is comprised between 1 and 70, preferably 5 and 60, more preferably 10 and 60.

Advantageously, the composition of the invention does not comprise phosphate builders.

Antiscalants

The antiscalants are those typically known by the person skilled in the art, these include polyacrylates of molecular weight from 1,000 to 400,000 examples of which are supplied by Dow, BASF and AkzoNobel. and polymers based on acrylic acid combined with other moieties. These include acrylic acid combined with maleic acid, such as Sokalan CP5 and CP7 supplied by BASF or Acusol 479N supplied by Dow; with phosphonate such as Casi 773 supplied by Buckman Laboratories; with maleic acid and vinyl acetate such as polymers supplied by Huls; with acrylamide; with sulfophenol methallyl ether such as Aquatreat AR 540 supplied by AkzoNobel; with 2-acrylamido-2-methylpropane sulfonic acid such as Acusol 587D supplied by Dow or such as K-775 supplied by Goodrich; with 2-acrylamido-2-methylpropane sulfonic acid and sodium styrene sulfonate such as K-798 supplied by Goodrich; with methyl methacrylate, sodium methallyl sulfonate and sulfophenol methallyl ether such as Alcosperse 240 supplied by AkzoNobel; polymaleates such as Belclene 200 supplied by BWA; polymethacrylates such as Tamol 850 from Dow; polyaspartates; ethylenediamine disuccinate; organo polyphosphonic acids and their salts such as the sodium salts of amino tri(methylenephosphonic acid) and ethane 1-hydroxy-1,1-diphosphonic acid.

The weight ratio of anti-scalant regarding the total weight of the composition is ratio typically known from the person skilled in the art, especially comprised between 0.05% to about 10% by weight, preferably from 0.1% to about 5% by weight, most preferably from about 0.2% to about 5% by weight.

Surfactants

Surfactants and especially nonionics may be present to enhance cleaning and/or to act as defoamer. Typically used nonionics are obtained by the condensation of alkylene oxide groups with an organic hydrophobic material which may be aliphatic or alkyl aromatic in nature, e.g. selected from the group consisting of a C2-C18 alcohol alkoxylate having EO, PO, BO and PEO moieties or a polyalkylene oxide block copolymer.

The surfactant may be present in a concentration of about 0% to about 10% by weight, preferably from 0.5% to about 5% by weight, most preferably from about 0.2% to about 3% by weight.

Advantageously, the composition of the present invention does not comprise other surfactant or compound having surfactant property than the cationic polysaccharide of the invention.

The invention also relates to a composition comprising 0.1 to 1 wt % of cationic polysaccharide and less than 2% of surfactant or compound having other surfactant property.

Bleaches

Suitable bleaches for use in the system according the present invention may be halogen-based bleaches or oxygen-based bleaches. More than one kind of bleach may be used, As halogen bleach, alkali metal hypochlorite may be used. Other suitable halogen bleaches are alkali metal salts of di- and tri-chloro and di- and tri-bromo cyanuric acids. Suitable oxygen-based bleaches are the peroxygen bleaches, such as sodium perborate (terra- or monohydrate), sodium carbonate or hydrogen peroxide.

The amounts of hypochlorite, di-chloro cyanuric acid and sodium perborate or percarbonate preferably do not exceed 15%, and 25% by weight, respectively, e.g. from 1-10% and from 4-25% and by weight, respectively.

Enzymes

Amylolytic and/or proteolytic enzymes would normally be used as an enzymatic component. The amylolytic enzymes usable herein can be those derived from bacteria or fungi.

Minor amounts of various other components may be present in the chemical cleaning system. These include solvents, and hydrotropes such as ethanol, isopropanol and xylene sulfonates, flow control agents; enzyme stabilizing agents; anti-redeposition agents; corrosion inhibitors; and other functional additives.

In one embodiment, the composition according to the invention does not comprise surfactant.

The composition of the invention can be formulated into various forms, for example into the form of a tablet, into powder or into the form of a liquid composition, preferably into the form of powder or tablet.

The composition of the present invention is advantageously a 2 in 1 detergent composition having anti-spotting and/or anti-filming effects.

The invention also relates to the use of cationic polysaccharide of average molecular weight less than 1,000,000 g/mol in detergent composition, especially ADW detergent composition, to eliminate, limit or prevent the spotting and/or filming phenomena. The cationic polysaccharide being such as described above.

The invention also relates to a process for preventing, eliminating or limiting the spotting and/or filming phenomena due to washing, especially in ADW, comprising the use of a detergent composition comprising at least a cationic polysaccharide of molecular weight less than 1,000,000 g/mol. The cationic polysaccharide and the composition being such as described above.

The invention will now be described in further details using the following non-limiting examples.

EXAMPLES 1-2

Cationic Polysaccharide Synthesis

MEANING OF ABBREVIATIONS OR ACRONYMS USED IN THE SYNTHESIS EXAMPLES

QUAB 151: 2,3-epoxypropyltrimethylammonium chloride

QUAB 188: 3-chloro-2-hydroxypropyltrinethylammonium chloride

After each synthesis, the final product is analyzed by SEC-MALS (size exclusion chromatography with detection by multi-angle light-scattering detection). The average molar masses are expressed by weight. The degree of cationic substitution ($DS_{cat}$) was analyzed by 1H NMR and expresses the average number of moles of cationic substitution per mole of sugar unit.

EXAMPLE 1

The derivatized polysaccharide polymer of Example 1 was made using the following reagents in the ensuing amounts and using methods known to those skilled in the art, such as those published on U.S. Pat. No. 5,756,720 and EP 1501873

More precisely, the polymer of Example 1 was made in the following manner:

In a 1 liter stirred reactor, 197 g of isopropanol solvent mixed with 88 g of de-ionized water were introduced at room temperature, under a blanket of inert nitrogen gas. 102 g of guar flour, (molecular weight of 1-2 million g/mol and a particle size of 200-500 micron) were then loaded at room temperature and under vigorous stirring. After a few minutes of stirring to allow for homogenization the pH of the dispersion was adjusted with the addition of 4.3 g of acetic acid, 99%. 8.8 g of peracetic acid, 32% solution in dilute acetic acid, were added to effect the depolymerization of guar. Once homogenization is allowed by mixing for 30 minutes, the dispersion was heated to 45° C. and held at this temperature for 30 more minutes. The pH of the guar dispersion was then adjusted to a value of 8 and the reaction was then held at temperature until most peracetic acid was consumed, as measured using peroxide strips (<2 hours).

Once the depolymerization was finished the reaction temperature was lowered to room temperature and 38.3 g of 2,3-epoxypropyltrimethylammonium chloride were added. This reagent was left to mix at room temperature with the guar dispersion for 20 minutes, after which 38 g of sodium hydroxide (25%), were added slowly. The dispersion was then heated to 65° C. and held at this temperature for 90 minutes, after which the temperature was lowered to at least 50° C. in order to start the washing procedure.

A reaction mixture obtained as described in the paragraph above was dispersed under stirring with 170 g of isopropanol, 32 g of water and 11 g of acetic acid, 99%. It was then left under stirring for 15 minutes and then discharged from the reactor. This dispersion was then filtered under vacuum through qualitative filter paper. This washing and filtering procedure was repeated once more for 30 minutes with 192 g of isopropanol mixed with 32 g of water. The obtained guar powder was finally mixed with 272 g of isopropanol, left to stir for 30 minutes, and filtered. The collected solids were then left to dry overnight in air and then for 4 h in a vacuum oven at 50° C.

The cationic degree of substitution ($DS_{cationic}$) was measured according to the procedure detailed in the description.

The analytical results obtained for the above sample yielded a $(DS_{cat})_{extraction}$ by 1H NMR in accordance with the invention, more especially ranging between 0.03 and 0.3.

The average molecular weight of the cationic polysaccharide was measured by SEC-MALS analyses according to the procedure detailed in the description and using the following conditions:

Column: Shodex OHpak SB-806M HQ, 3 columns

Mobile phase: 100 mM $Na_2NO_3$, 200 ppm $NaN_3$, 20 ppm pDADMAC

Flow rate: 1.0 ml/min

Detector: Agilent Refractive Index Detector, Wyatt mini DAWN TRISTAR MALS detector Injection volume: 100 μl Temperature: ambient Run time: 50 minutes The molecular weight was about $2.0\times10^5$ g/mol.

EXAMPLE 2

The derivatized polysaccharide polymer of Example 2 is a guar sold by Rhodia under the trade name Jaguar C500®.

This guar exhibits a $(DS_{cat})_{extraction}$ in accordance with the invention (and more especially comprised between 0.03 and 0.3, measured according to the procedure detailed in the description).

This guar also has an average molecular weight in accordance with the invention (and more especially comprised between 200,000 and 600,000 g/mol, measured by SEC-MALS analyses according to the procedure detailed in the description).

EXAMPLE 3

This example demonstrates the performance of the polysaccharide of the invention regarding commercially available polymers of higher molecular weights.

Machine Dishwashing Detergent formulation used for all examples is prepared as described in Table 1.

TABLE 1

Formulation used in the example

| Ingredients | weight percentage |
|---|---|
| Sodium sulfate | 6 |
| Tri-sodium citrate dihydrate | 36 |
| Sodium carbonate | 15 |
| Sodium silicate | 22.5 |
| Acrylate/sulfonate copolymer[1] | 5 |
| Sodium percarbonate | 10 |
| Tetraacetyl ethylene diamine | 2.5 |
| Enzyme protease | 1.5 |
| Enzyme amylase | 1.5 |

([1]Acusol 587D ex DOW)

2 clean glasses were placed on the upper rack of an Bosch "Auto 3 en 1" automatic dishwasher.

50 g Food Soil, was frozen and then placed on the bottom rack of the dishwasher. The soil consists in weight percentage of 25.0%, eggs, 55.5% water, 2.50% powdered milk, 0.5% sunflower oil, 1% mustard, 15% ketchup and 0.5% salad dressing.

A Normal wash program consisted of a 65° C. main wash followed by two heated rinses (65° C.) and a heated dry cycle. Water Hardness was adjusted to 30° TH.

The polysaccharide was blended with the formulation (TABLE 1). The concentration of polysaccharide is 1% by weight of the total blend.

20.0 g of blend were dosed via the dispenser cup of the automatic dishwasher.

After completion of the three wash programs, the appearance of the washed glassware was assessed visually using a light box as described in section 4.4 of ASTM Method D 3556-85. The light box is essentially a darkened room with the glasses being placed on racks and illuminated from within to disclose spots or film. All interior surfaces of the light box are black, so that the only light present is that which passes up through the tumblers.

Washed glasses were scored using a 0-5 scale in which 0 is completely covered with spots or heavy chalky film and 5 is clear. The rating scale is described further in section 6.6 of ASTM Method D-3556-85. Results are recorded in Table 2.

Specially for high molecular cationic guar, we observed microcrystalline spots, onto the glass surface.

TABLE 2

| Polymers used | Molecular mass of the polymer (g/mol) | spotting | filming |
|---|---|---|---|
| Control (no additives) | — | 1 | 4.5 |
| Product 1 from example 1 | About $2 \times 10^5$ | 2 | 4.5 |
| Product 2 from example 2 | between 200,000 and 600,000 | 3 | 4.5 |
| Jaguar C17 | About $2.5 \times 10^6$ | microcrystalline spots | |
| Jaguar C1000 | About $1 \cdot 10^6$ | microcrystalline spots | |
| Jaguar C14S | About $2.5 \times 10^6$ | microcrystalline spots | |
| Polycare LR125 | About $3 \times 10^5$ | 3 | 4.5 |
| Polycare LR400 | About $4.4 \times 10^5$ | 3 | 4.5 |
| Polycare LR3000 | About $1.7 \times 10^6$ | microcrystalline spots | |

This example clearly demonstrates the ability of the polymers of this invention (i.e. cationic polysaccharide of molecular weight of less than 1,000,000 g/mol) to deliver glass appearance benefits superior to those of the polymers with molecular weight greater than 1,000,000 g/mol. The polymers of this invention clearly provide a glassware appearance benefit superior to any that may be provided by the antiscalant polymers.

EXAMPLE 4

This example illustrates the effects of polysaccharides on water sheeting of hydrophobic surface like plastic surface. Water sheeting capability provides better drying behaviour with less spotting onto plastic surface at the end of the dry cycle.

Machine Dishwashing Detergent formulation used for all examples is prepared as described in Table 1.

Three plastic coupons (Polypropylene, Polyethylene and Polycarbonate) were cleaned with ethanol and then placed on the upper rack of an Bosch Auto 3 en 1 automatic dishwasher.

50 g Soil, was frozen and then placed on the bottom rack of the dishwasher. The soil consists of 25.0% eggs, 55.5% water, 2.50% powdered milk, 0.5% sunflower oil, 1% mustard, 15% ketchup and 0.5% salad dressing.

A Normal wash program consisted of a 65° C. main wash followed by two heated rinses (65° C.) and a heated dry cycle. Water Hardness was adjusted to 30° TH.

The polysaccharide was blended with the formulation (TABLE 1). The concentration of polysaccharide is between 1% by weight of the total blend. 20.0 g of blend were dosed via the dispenser cup of the automatic dishwasher.

After completion of three wash programs, the water sheeting of the washed plastic coupons was assessed visually using the procedure described below.

Water is sprayed onto the plastic surface and the behaviour of the water droplets was visually observed.

Initial plastic coupons (just washed with ethanol) and washed plastic coupons were scored using a "−/++" scale in which "−" is completely covered with sticking water droplet and "++" is completely covered by a water sheet. The rating scale is described below in Table 3

TABLE 3

| Water sheeting rating scale | |
|---|---|
| Score | Meaning |
| – | The water droplets stick to the surface |
| 0 | The water droplets gather, water sheeting quickly retracts |
| + | Water sheeting gently retracts |
| ++ | Complete water sheeting with no retraction |

In categorizing the sheeting result, sheeting characteristic is considered to be excellent on a substrate if "complete sheeting" is observed, that corresponds to score ++.

The results obtained on washed plastic coupons are recorded in table 4

TABLE 4

| Effect of polysaccharide on water sheeting | | | | |
|---|---|---|---|---|
| Polymers used | Molecular mass of the polymer (g/mol) | Poly-propylene | Poly-ethylene | Poly-carbonate |
| Initial (ethanol washed) | — | 0 | 0 | 0 |
| Control (no additives) | — | 0 | 0 | 0 |
| Product 1 from example 1 | About $2 \times 10^5$ | + | + | + |
| Product 2 from example 2 | between 200,000 and 600,000 | + | ++ | ++ |
| Jaguar C17 | About $2.5 \times 10^6$ | 0 | 0 | + |
| Jaguar C14S | About $2.5 \times 10^6$ | 0 | + | + |
| Jaguar C1000 | About $1 \times 10^6$ | 0 | 0 | + |
| Polycare LR3000 | About $1.7 \times 10^6$ | 0 | 0 | 0 |

This example clearly demonstrates the ability of the essential polymers of this invention to deliver water sheeting benefits superior to those of the other polymers used in this example. The essential polymers of this invention clearly provide a water sheeting benefit. This benefit provides better drying behavior with less spotting onto plastic surface at the end of the dry cycle.

The invention claimed is:

1. A method for eliminating, limiting or preventing the spotting and/or filming phenomena during washing in an automatic dishwasher comprising adding a detergent composition comprising at least one cationic guar or guar derivative during washing, wherein the composition is an automatic dishwashing detergent composition comprising sodium carbonate and sodium sulfate, wherein said cationic guar or guar derivative has a molecular weight comprised between 50,000 and 800,000 g/mol.

2. The method according to claim 1, wherein the cationic guar or guar derivative has a molecular weight comprised between 200,000 and 600,000 g/mol.

3. The method according to claim 1, wherein the cationic guar or guar derivative has a degree of cationic substitution comprised between 0.01 and 0.4.

4. The method according to claim 1, wherein the cationic guar or guar derivative has a degree of cationic substitution comprised between 0.03 and 0.3.

5. The method according to claim 1, wherein the cationic guar or guar derivative comprises cationic substituent chosen among quaternary ammonium group.

6. The method according to claim 1, wherein the cationic guar or guar derivative comprises a cationic group chosen from trialkylammonium groups; aryldialkylammonium groups; and/or ammonium radicals in which the nitrogen atom is a member of a cyclic structure.

7. The method according to claim 1, wherein the ratio by weight of the cationic guar in respect to the total weight of the composition is comprised between 0.1 and 10%.

8. The method according to claim 1, wherein the composition does not comprise other surfactant or compound having surfactant properties than the cationic guar or guar derivative.

9. The method according to claim 1, wherein the composition comprises 0.1 to 1 wt % of cationic guar or guar derivative and less than 2% of surfactant.

10. The method according to claim 1, wherein the composition does not comprise phosphate builders.

11. The method according to claim 1, wherein the composition does not comprise other surfactant than the guar nor phosphate builders.

12. The method according to claim 1, wherein the composition is in the form of tablets, liquid or powder.

13. The method according to claim 6, wherein the ammonium radical is selected from the group consisting of pyridinium and imidazoline.

14. The method according to claim 6, wherein the trialkylammonium groups are trimethyl ammonium, triethylammonium or tributylammonium groups; wherein the aryldialkylammonium groups are benzyldimethylammonium groups.

* * * * *